US005160239A

United States Patent [19]

Allen et al.

[11] Patent Number: 5,160,239

[45] Date of Patent: Nov. 3, 1992

[54] COORDINATED CONTROL FOR A WORK IMPLEMENT

[75] Inventors: William E. Allen; Paul D. Anderson; Walter J. Bradbury; John M. Hadank; Richard B. League, all of Peoria, Ill.

[73] Assignee: Caterpillar Inc., Peoria, Ill.

[21] Appl. No.: 578,909

[22] Filed: Sep. 6, 1990

Related U.S. Application Data

[63] Continuation-in-part of Ser. No. 501,381, Mar. 19, 1990, Pat. No. 5,002,454, which is a continuation of Ser. No. 241,654, Sep. 8, 1988, abandoned.

[51] Int. Cl.[5] ..... E02F 3/32

[52] U.S. Cl. ..... 414/699; 172/4.5; 364/167.01; 37/DIG. 7

[58] Field of Search ..... 414/694, 695.5, 699, 414/700, 701, 708, 718, 728; 172/4.5; 364/167.01; 91/508; 37/DIG. 7

[56] References Cited

U.S. PATENT DOCUMENTS

| | | | |
|---|---|---|---|
| 3,187,911 | 6/1965 | Christenson | 414/699 |
| 3,388,821 | 6/1968 | White, Jr. | 414/715 |
| 4,332,517 | 6/1982 | Igarashi et al. | 414/699 X |
| 4,910,662 | 3/1990 | Heiser et al. | 414/700 X |
| 4,923,362 | 5/1990 | Fryk | 414/700 |
| 5,002,454 | 3/1991 | Hadnak et al. | 414/695.5 |

FOREIGN PATENT DOCUMENTS

| | | | |
|---|---|---|---|
| 0361666 | 4/1990 | European Pat. Off. . | |
| 0163332 | 12/1981 | Japan | 37/DIG. 7 |
| 0195937 | 11/1984 | Japan | 414/699 |

OTHER PUBLICATIONS

Patent Abstracts of Japan, vol. 10, No. 191 (M-495)(2247) Jul. 4, 1986 & JP,A,61 036 426 (Hitachi Const. Mach Co.) Feb. 21, 1986.

Patent Abstracts of Japan, vol. 14, No. 212 (M-969)(4155) May 2, 1990 & JP,A,02 047 432 (Sumitomo Constr. Mach. Co.) Feb. 16, 1990.

*Primary Examiner*—Robert J. Spar
*Assistant Examiner*—Donald W. Underwood
*Attorney, Agent, or Firm*—James R. Yee

[57] ABSTRACT

A control system is adapted to provide substantially linear movement of a work implement. The control system receives signals from at least one control lever and coordinates the movements of the work implement's appendages through coordination of hydraulic cylinders.

14 Claims, 6 Drawing Sheets

100
102
104
106
108
110
111
112
114
115
116
117
118
120
122
124
126
128
130
132
134
136
138
140
142
143
144
145
146
148
150
152
154

COORDINATED CONTROL FOR A WORK IMPLEMENT

This is a continuation-in-part of application Ser. No. 07/501,381, filed Mar. 19, 1990, issued Mar. 26, 1991, as U.S. Pat. No. 5,002,454 which is a file wrapper continuation of application Ser. No. 07/241,654, filed Sept. 8, 1988, now abandoned.

DESCRIPTION

1. Technical Field

This invention relates generally to a control system for controlling a work implement on a work vehicle, and more particularly to a control system which provides a coordinated control interface between the work implement and the vehicle operator.

2. Background Art

In the field of work vehicles, particularly those vehicles which perform digging or loading functions such as excavators, backhoe loaders, and front shovels, a work implement is generally controlled by a manual control system having two or more operator control levers, and additionally, other vehicle control devices. Typically, the manual control system often includes foot pedals as well as hand operated levers. A backhoe manufactured by J. I. Case Manufacturing Co., for example, employs three levers and two pedals to control the work implement. A backhoe manufactured by Ford Motor Co. utilizes four control levers. There are drawbacks associated with these implement control schemes. One is operator stress and fatigue resulting from having to manipulate so many levers and pedals. Further, a vehicle operator is required to possess a relatively high degree of expertise to manipulate and coordinate the control levers and foot pedals proficiently. To become productive, an inexperienced operator also requires a long training period to be familiar with the controls and their functions.

Some manufacturers recognize the disadvantages of having too many controls, and have adopted a two-lever control scheme as the norm. Generally, two vertically mounted two-axis levers share the task of controlling the movement of the work implement,s appendages (boom and stick) and the bucket of the work implement. For example, hydraulic excavators presently manufactured by Caterpillar Inc. employ one joystick for stick and swing control, and another joystick for boom and bucket control. Similarly, Deere & Co. has a hydraulic excavator with a joystick for boom and swing control, and another for stick and bucket control. In each instance, the number of controls has decreased to two, making machine operation much more manageable. However, these two-lever control schemes are still not wholly desirable. The assignment of implement linkages to the joysticks is entirely arbitrary, and there exists little correlation between the direction of movement of the work implement linkages and those of the control levers.

Further, in a typical leveling operation (or slope finish) the operator has to manipulate the control levers about or along at least three axes to produce a linear movement of the bucket. The complexity and skill involved increase when performing these types of operations, thereby increasing operator fatigue and required training time.

The present invention is directed to overcoming the problems set forth above.

DISCLOSURE OF THE INVENTION

In one aspect of the present invention, moving a vehicle,s control system for controllably work implement is provided. The work implement includes a first appendage pivotally connected to the vehicle, and a second appendage pivotally connected to the first appendage. At least one hydraulic cylinder controllably moves the first appendage relative to the vehicle. Another hydraulic cylinder moves the second appendage (106) relative to the first appendage . A control lever produces a first control signal and the control system produces a substantially linear motion of the end point of the second appendage.

In a second aspect of the present invention, a method for controlling a vehicle's work implement is provided. The work implement includes a bucket pivotally connected to one end of a stick. The stick is pivotally connected to a boom. The boom is pivotally connected to the work vehicle. The bucket, stick, and boom are independently, controllably, and pivotally movable in a first plane relative to one of the others. The bucket, stick, and boom are simultaneously, controllably, pivotally moveable to a plurality of second planes extending substantially vertically. Hydraulic cylinders controllably actuate the bucket, stick, and boom in response to received work implement control signals. The method includes the steps of: producing a set of electrical signals corresponding to the displacement and direction of the movement of a joystick in first and second directions in planes perpendicular at its longitudinal central axis, and corresponding to rotation of the joystick about the longitudinal axis and delivering a plurality of work implement control signals to the hydraulic cylinders in response to receiving the electrical signals. The hydraulic cylinders are then operated to coordinate bucket control of the vertical motion of the bucket.

BRIEF DESCRIPTION OF THE DRAWING

For a better understanding of an example of a control system according to the present invention, reference will now be made to the accompanying drawing, in which.

BEST MODE FOR CARRYING OUT THE INVENTION

Figure 1A:
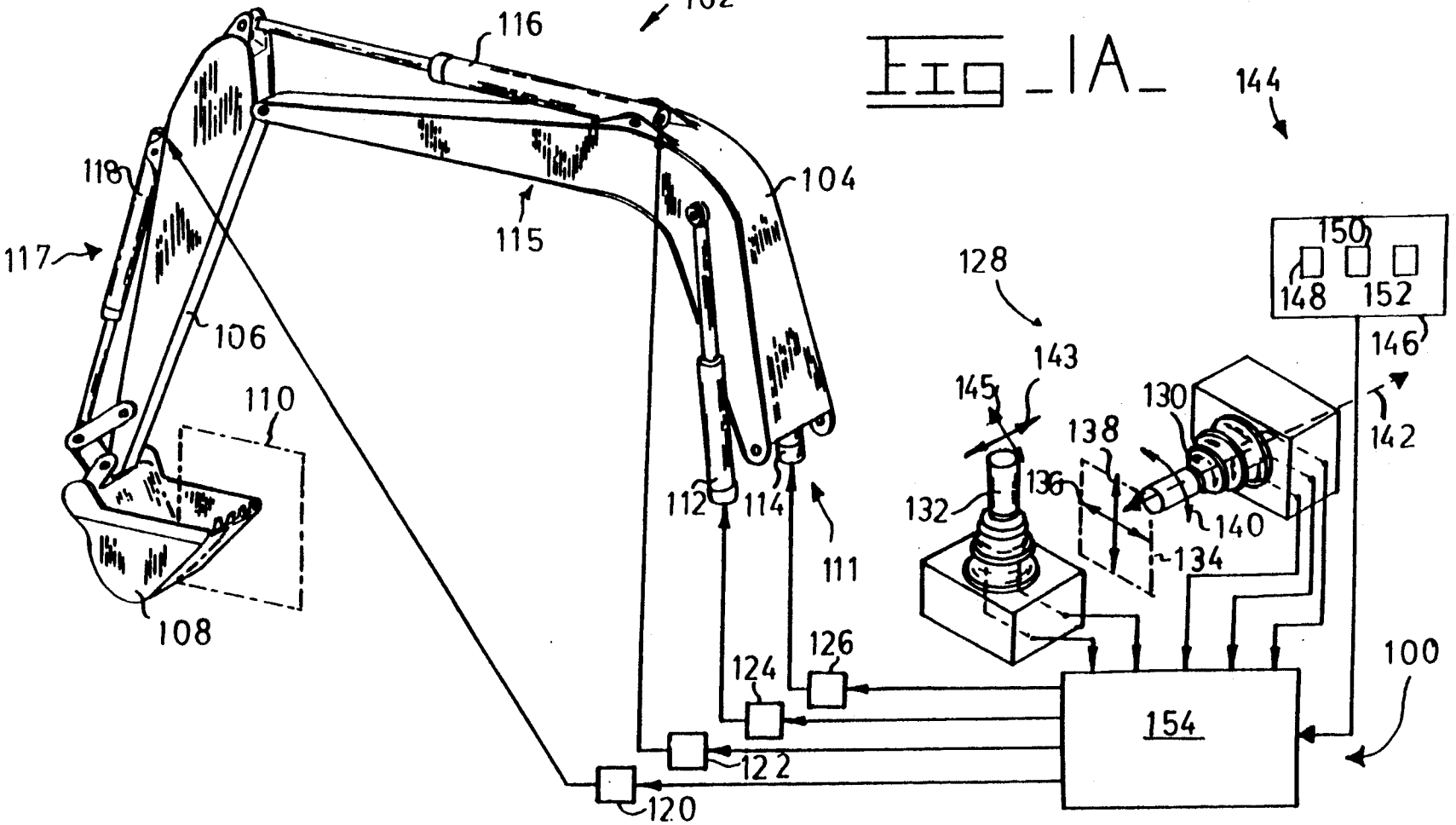
FIG. 1A is a diagrammatic view of the coordinated control system and the work implement.

With reference to FIG. 1A, the present invention 100, hereafter referred to as a coordinated control system, is adapted to controllably provide linear movement of a work vehicle's work implement 102. The work implement 102 typically includes a first appendage 104, a second appendage 106, and a third appendage 108. For discussion purposes, the work vehicle is a hydraulic excavator, but the instant control system 100 is also suitable for application on other vehicles such as backhoe loaders, front shovels, wheel loaders, track loaders, and skidders.

In the preferred embodiment, the appendages (or linkages) correspond to the boom 104, stick 106, and bucket 108 of the hydraulic excavator, as shown. However, the implement configuration can differ from machine to machine, and the configuration may include a working device other than a bucket, such as a clam shell or grapple. In certain machines, such as the excavator, the operator cab together with the work implement is rotatable along a vehicle center axis; in others, such as a the backhoe loader, the operator cab is stationary and the work implement is swingable to a different site at the pivot at the base of the boom. This difference is not significant and the implementation of the coordinated control system 100 in the two cases will be substantially identical.

The work implement 102 of the work vehicle is generally actuated in a vertical plane 110, and swingable, with the operator cab, to a plurality of second planes different from the first plane by rotating the vehicle platform or swinging at the pivot base of the boom. The boom 104 is actuated by a first actuating means 111 having two hydraulic cylinders 112,114 enabling raising and lowering of the work implement 102. The stick 106 is drawn toward and away from the vehicle by a second actuating means 115. The second actuating means 115 includes a hydraulic cylinder 116. A third actuating means 117 includes another hydraulic cylinder 118. The third actuating means 117 "opens" and "closes" the bucket (referred to as the curling function). The hydraulic flow to the hydraulic cylinders 112,114,116,118 are regulated by hydraulic control valves 120,122,124,126.

An operator interface means 128 provides operator input to the coordinated control system 100. The operator interface means 128 includes a first control lever 130 and a second control lever 132. In the preferred embodiment, the control levers 130,132 are inductive control levers (or joysticks). One suitable joystick is available from CTI Electronics of Bridgeport, Conn., USA, but other types may also be used.

In one embodiment, the first control lever 130 has three degrees of movement, all in one plane 134 substantially parallel to work implement plane 110: towards the front and rear of the vehicle (along a first control axis 136), vertically up and down (along a second control axis 138), and rotationally, shown by arrow 140 (about a third control axis 142). The second control lever 132 is movable to the left and right of the vehicle (along a fourth control axis 143).

In another embodiment, the first control lever 130 has two degrees of movement: along the first control axis 136 and along the second control axis 138. The second control lever 132 also has two degrees of movement: along the fourth control axis 143 and towards the front and the rear of the vehicle (along a fifth control axis 145).

The first control lever 130 generates one signal for each respective degree of movement, each signal representing the control lever displacement direction and velocity from neutral. Similarly, the second control lever 132 generates a signal for the left-right displacement direction and velocity for implement side swing control.

A means 144 generates an electrical signal indicative of a desired slope angle (discussed below). In the preferred embodiment, the means 144 includes a thumb wheel switch 146 having three indicators 148,150,152. The first indicator 148 is movable between a positive position (indicative of a positive desired slope angle) and a negative position (indicative of a negative desired slope angle). The second and third indicators 150,152 are each movable between ten positions (0–9) representing the magnitude of the desired slope angle (between zero and ninety degrees).

The electric signals are received by a logic means 154, which in response delivers to the hydraulic control valves 120,122,124,126 a plurality of work implement control signals.

Figure 1B:
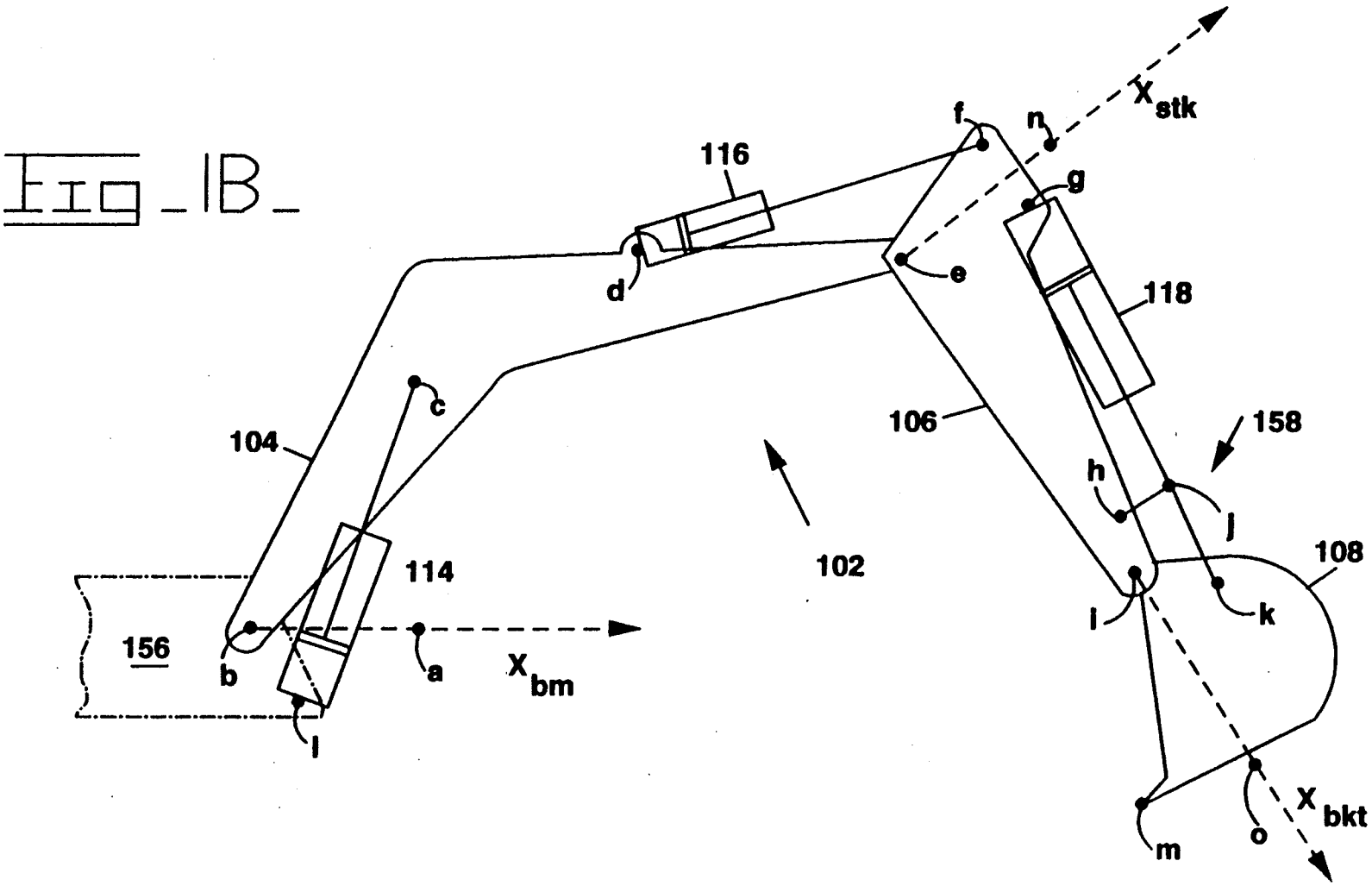
FIG. 1B is a diagrammatic view of the work implement illustrating pertinent points on the work implement.

Referring to FIG. 1B, a planar view of the work implement 102 is shown, defining a number of points and axes used by the logic means 154. The work implement 102 is pivotally mounted on a portion of the excavator's cab 156 at pivot point b. An axis, $X_{bm}$, is defined, having an origin at point b and a constant direction with respect to the cab 156. Axis $X_{bm}$ is used to measure the relative angular relationship between work vehicle 156 and the boom 104. Point a is defined as a point on axis $X_{bm}$. The boom hydraulic cylinders 112,114 (for simplicity only one is shown) is connected between the work vehicle 156 and the boom 104 at points 1 and c, respectively.

The stick 106 is pivotally connected to the boom 104 at point e. The stick hydraulic cylinder 116 is connected between the boom 104 and the stick 106 at points d and f, respectively. An axis, $X_{stk}$, is defined, having an origin at point e and a direction constant with respect to the boom 104. Axis $X_{stk}$ is used to measure the relative angular relationship between the boom 104 and the stick 106. Point n is defined as a point on axis $X_{stk}$.

The bucket 108 is pivotally connected to the stick 106 at point i. An axis $X_{bkt}$ is defined, having an origin at point i and a constant direction with respect to the stick 106. Point o is defined as a point on $X_{bkt}$. The bucket hydraulic cylinder 118 is connected to the stick 106 at point g and to a linkage 158 at point j. The linkage 158 is connected to the stick 106 and the bucket 108 at points h and j, respectively. A point m is defined at the tip of the bucket 108.

Figure 2:
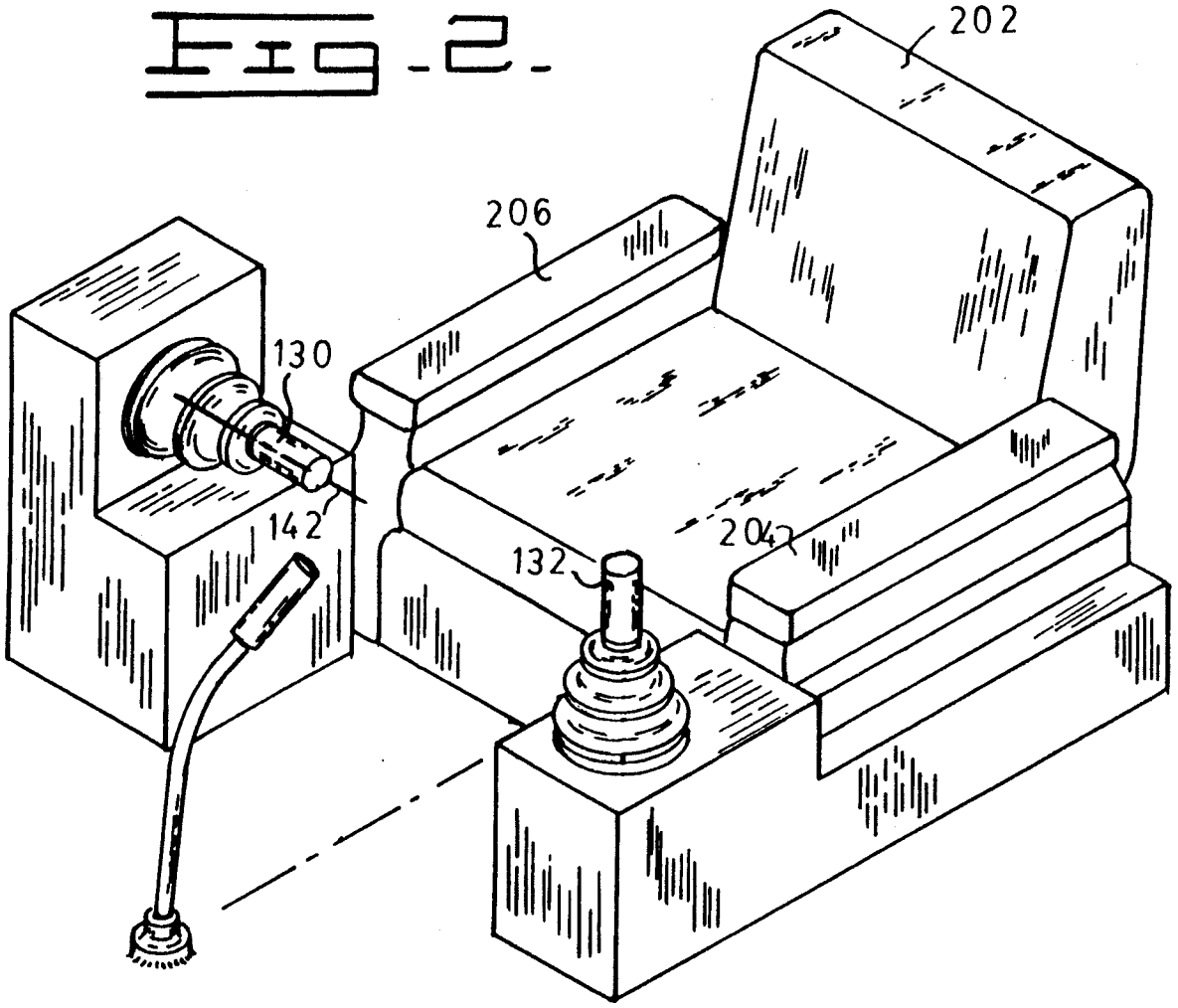
FIG. 2 is an isometric view of the control levers mounted with respect to an operator seat.

Referring now to FIG. 2, an isometric view of the operator seating area and manual controls is shown. The operator, when seated in an operator seat 202, can rest his or her arms on arm rests 204,206 where the control levers 130,132 are within easy reach. In one embodiment, the first control lever 130 is mounted substantially horizontal and the second control lever 132 is mounted substantially vertical, as shown. In another embodiment, both control levers 130,132 are mounted substantially vertical.

In one embodiment of the instant invention, the control system 100 has five modes of operation: manual control mode, linear control mode, linear with constant bucket attitude control mode, slope finish control mode, and slope finish with constant bucket attitude control mode. Each mode is explained in depth below.

In the manual control mode, the control levers 130,132 control movement of the work implement appendages (boom, stick, bucket) 104,106,108 independently, that is, movement of the first control lever 130 along a specific control axis 136,138,142 corresponds to a specific linkage on the implement.

In one embodiment, movement of the first control lever 130 in directions along the first control axis 136 controls the flow of hydraulic fluid to the stick hydraulic cylinder 116 and movement of the first control lever 130 in directions along the second control axis 138 controls the flow of fluid to the boom hydraulic cylinders 112,114. Further, rotational movement of the first control lever 130 about the third control axis 142 controls the curling motion of the bucket 108 and movement of the second control lever 132 along the fourth control axis 143 controls the swing motion of the excavator cab.

In another embodiment, movement of the horizontal control lever 130 in directions along the first control axis 136 controls the flow of hydraulic fluid to the boom hydraulic cylinders 112,114 and movement of the horizontal control lever 130 in directions along the second control axis 138 controls the curling motion of the bucket 108. Further, movement of the second control lever 132 along the fourth control axis 143 controls the swing motion of the excavator cab and along the fifth control axis 145 controls the flow of hydraulic fluid to the stick hydraulic cylinder 116.

Figure 3A:
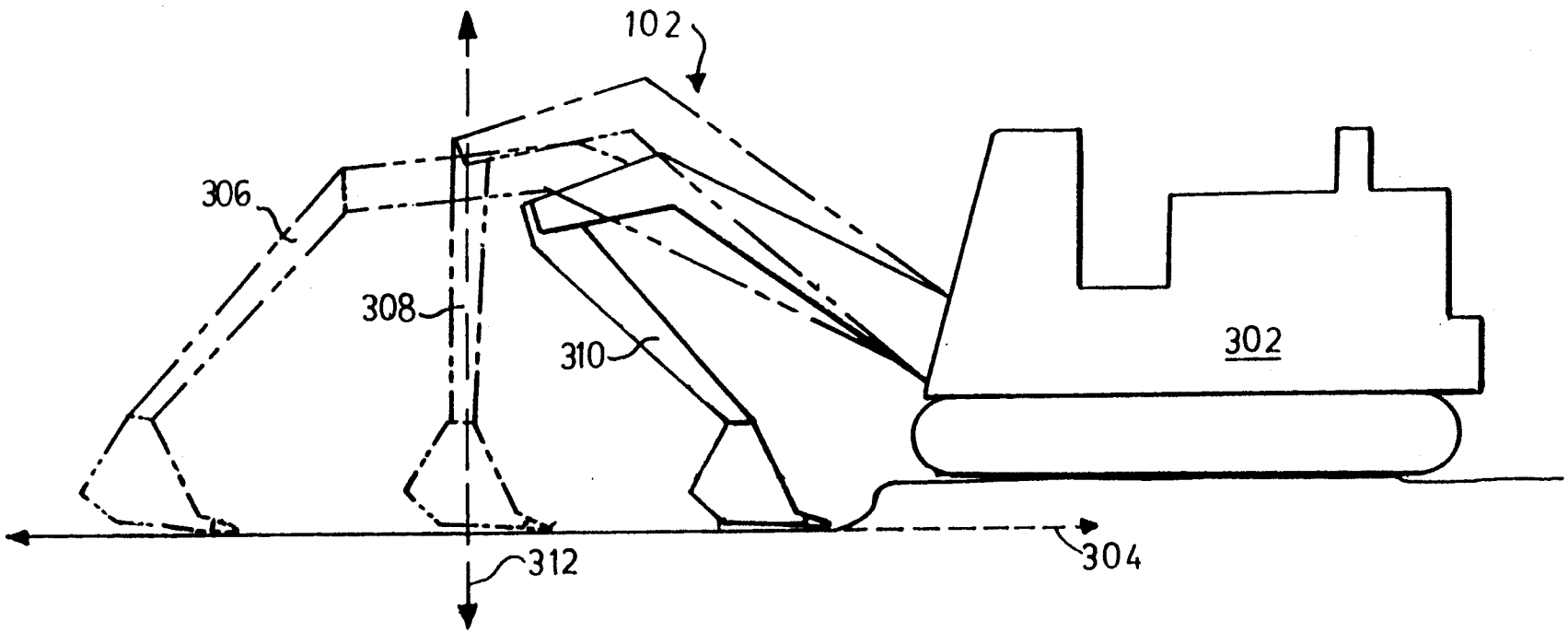
FIG. 3A is a side view of the vehicle performing bucket level motion with phantom lines illustrating implement movement.
Figure 3B:
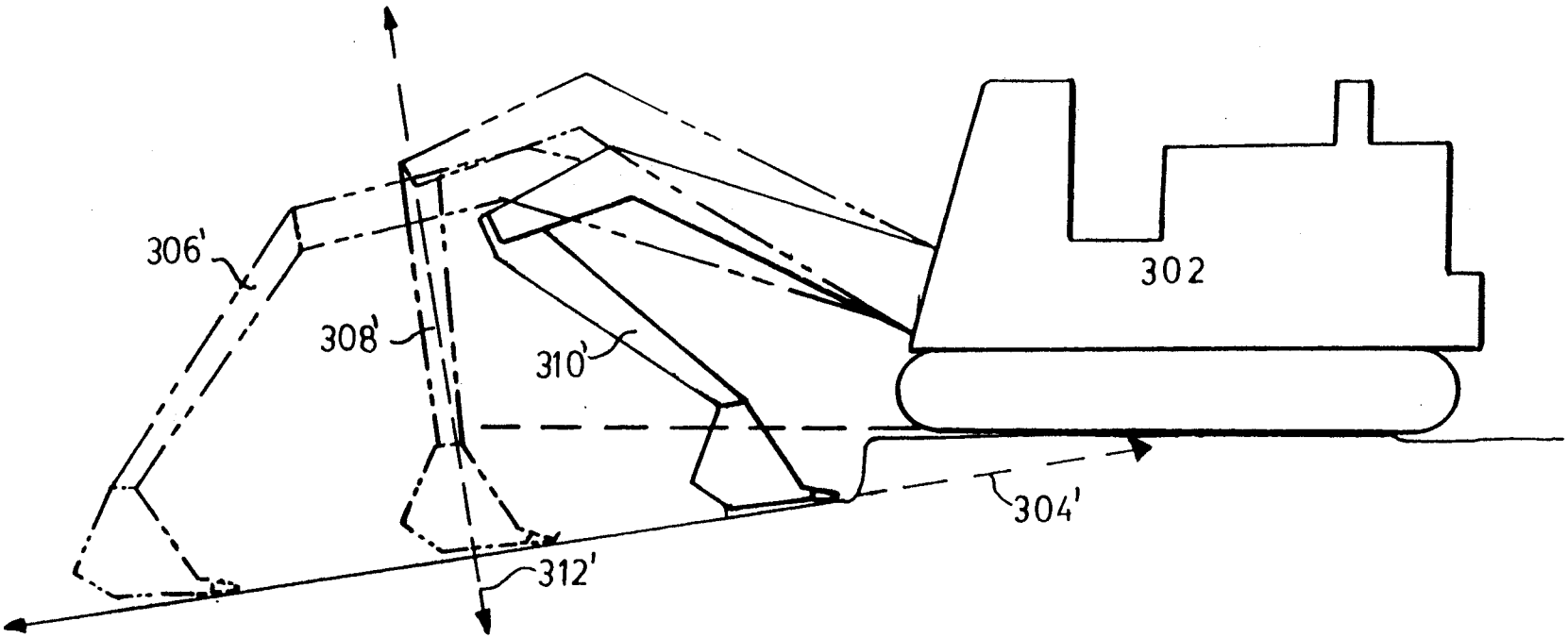
FIG. 3B is a side view of the vehicle performing slope finish motion with phantom lines illustrating implement movement; and, FIG. 4 is a block diagram of the coordinated control implementation.

In the four remaining modes, the control of the appendage movements are simultaneously coordinated to provide linear movement. With reference to FIGS. 3A and 3B, the work implement 102 of a work vehicle 302 has a substantially linear bucket motion with respect to the vehicle 304. In all four coordinated modes, the direction and velocity of the linear motion is prescribed by the movement of one control lever 130,132 along one control axis 136,138,143,145.

In one embodiment of the linear control mode, movement of the control levers 130,132 along or about the control axes 136,138,142,143 provide the following functions:

| | |
|---|---|
| first control axis 136 | linear horizontal movement of point i |
| second control axis 138 | linear vertical movement of point i |
| third control axis 142 | curling function of the bucket, and |
| fourth control axis 143 | swing control. |

With reference to FIG. 3A, movement of the first control lever 130 along the first control axis 136 provides a linear horizontal movement of point i. The linear motion of point i is accomplished by automatically coordinating the flow of hydraulic fluid to the boom and stick cylinders 112,114,116 (discussed below). Manual control over the curling and swing functions remain the same as in the manual control mode.

In another embodiment of the linear control mode, the control levers 130,132 are each moveable along two control axes 136,138,143,145. Movement along each control axis 136,138,143,145 corresponds to one of the control functions, as described above.

In still another embodiment, the angular relationship between the bucket and the stick remains constant and linear motion of point m is provided. In other words, the bucket 108 is treated as an extension of the stick 106.

The linear with constant bucket attitude mode is similar to the linear control mode, except that manual control over the curling function is eliminated. Linear motion of point i is provided in the same manner as described above. In addition the actuation of the bucket hydraulic cylinder 118 is coordinated such that a constant bucket angle with respect to the vehicle 302 is maintained. Therefore, in drawing the bucket level toward the vehicle, all three linkages require simultaneous and coordinated control.

FIG. 3A specifically illustrates linear motion of the work implement along a first work axis 304. The first work axis 304 is substantially parallel to the plane of the vehicle 302. In the first phantom outline 306, the stick is out and the bucket is in a closed position. As the first control lever 130 is pulled towards the rear of the vehicle along the first control axis 136, the work implement 102 is drawn to the position shown by the second phantom outline 308, the boom is raised, stick closer to the vehicle, and the bucket in a more open position. At the final position shown by the solid outline 310, the boom is lowered, the stick is drawn in, and the bucket is open.

Linear vertical movement along a second work axis 312 is performed in response to movement of the first control lever 130 along the second control axis 138 in a similar manner. The second work axis 312, shown at the second phantom outline 308, is perpendicular to the first work axis 304.

FIG. 3B specifically illustrates linear motion of the work implement along a first work axis 304. The first work axis 304, has an angular relationship with the vehicle 302. The slope angle is defined by the means 144. In the first phantom outline 306,, the stick is out and the bucket is in a closed position. As the first control lever 130 is pulled towards the rear of the vehicle along the first control axis 136, the work implement 102 is drawn to the position shown by the second phantom outline 308,, the boom is raised, stick closer to the vehicle, and the bucket in a more open position. At the final position shown by the solid outline 310', the boom is lowered, the stick is drawn in, and the bucket is open.

Linear vertical movement along a second work axis 312, is performed in response to movement of the first control lever 130 along the second control axis 138 in a similar manner. The second work axis 312', shown at the second phantom outline 308', is perpendicular to the first work axis 304, In a vehicle with conventional controls where each linkage is controlled independently, all the linkage motions are explicitly controlled and manipulated by the operator. Since the primary concern of the vehicle operator is the placement of the bucket, all four coordinated control modes of the instant invention allows exact operator displacement and directional control of the bucket regardless of the geometry of the work implement. Therefore, to perform bucket level motion such as in floor finishing, the operator needs only move the first control lever 130 towards the front or rear of the vehicle.

In the preferred embodiment, the logic means 154 is implemented on a microcontroller. Typically, the microcontroller is microprocessor based. One suitable microprocessor is available from Motorola Inc of Roselle, IL as part no. MC68HCll, but any suitable microprocessor is applicable.

Figure 4:
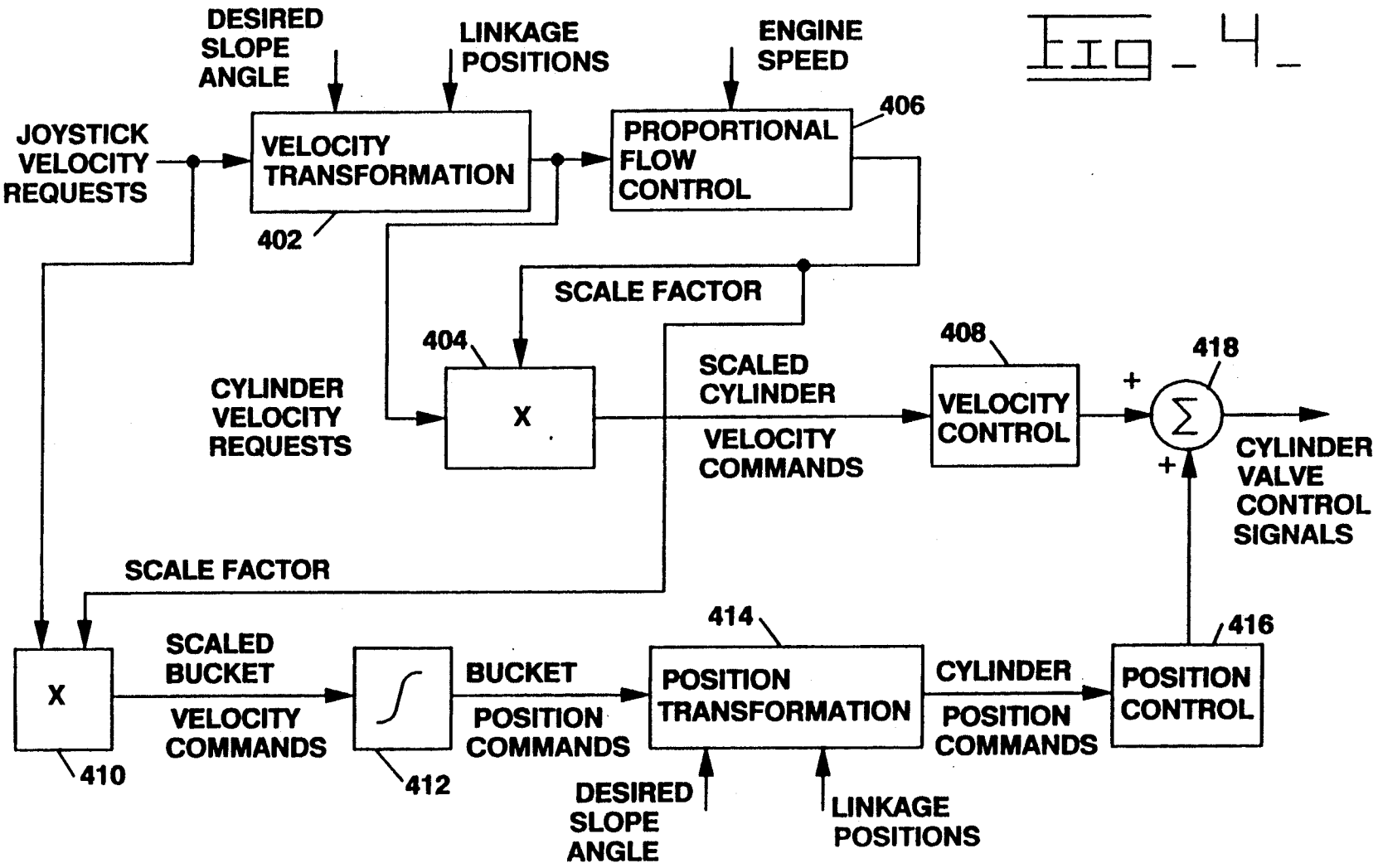

Referring now to FIG. 4, a block diagram of the coordinated control as implemented on the logic means 154 in software is shown. The electric signals which are generated by the control levers 130,132 are shown as joystick velocity request inputs to the block diagram. These velocity request signals are in Cartesian coordinates corresponding to the control lever movement. The velocity requests are transformed at block 402 to a different coordinate system based on the configuration and position of the linkages. The velocity transformation also receives linkage position data from sensors such as linkage angle resolvers and cylinder position sensors such as known in the art. Examples may be found in *Robot Manipulators: Mathematics, Programming and Control* by Richard P. Paul, MIT Press, 1981.

The upper portion of the coordinated control implementation of FIG. 4 (blocks 402,404,406,408) provides for manual control of the flow of hydraulic fluid to the hydraulic cylinders 112,114,116,118 through the use of the control levers 130. The cylinder velocity requests (or joint angular velocity) from this translation process are scaled at block 404 by a factor obtained in the proportional flow control block 406. Proportional hydraulic flow control is discussed in U.S. Pat. No 4,712,376 issued to Hadank and Creger on Dec. 15, 1987. The basic concept of the proportional flow control involves calculating the amount of hydraulic flow available for implement actuation under current operating conditions (that is, engine speed, vehicle travel, etc.) The resultant scaled velocity request from block 404 is passed on to velocity control block 408 where an open or closed loop control determines the hydraulic valve velocity control signals to satisfy the cylinder velocity request. Such open or closed loop control systems are well known in the field of control theory and are therefore not discussed further. The hydraulic control valve signals are complemented with another set of signals to eliminate errors introduced in the Cartesian to linkage coordinate transformation.

Referring now to block 410, the joystick velocity requests are scaled with the same factor obtained in proportional flow control. The scaled joystick velocity commands are integrated over time to obtain position commands 412 and transformed to the linkage coordinates 414. This transformation is similar to that of the transformation process in block 402. The output of position transformation block 414 is then passed on to another open or closed loop control 416 where hydraulic valve position control signal is determined. A suitable closed loop control using position and velocity control is disclosed in U.S. patent application Ser. No. 07/540,726, filed on Jun. 15 1990 and commonly assigned.

The hydraulic valve control signals from both branches are combined at an adder 418 to arrive at the final cylinder valve control signals for the work implement. In the manual mode the lower portion of the control implementation is non-operable; the cylinder valve control signals are directly related to the velocity requests from the control levers (joysticks) 130,132.

While running in one of the coordinated control modes, the lower portion (blocks 410–416) of the control implementation are effective and part of the upper portion may also be operable. For example, in the linear with bucket attitude control mode, the lower portion of the control implementation coordinates the flow of fluid to the hydraulic cylinders 112,114,116,118 in accordance with the horizontal and vertical velocity requests. The swing motion of the work implement 102 remains under manual control through blocks 402–408. Further, a bucket velocity request may be accepted by the control implementation from one of the control levers 130,132. This signal would be modified (as discussed above) to produce a bucket cylinder correction signal. The bucket cylinder correction signal would be added to the requested bucket velocity signal from the lower portion of the control implementation. This function allows the operator to correct, modify, or adjust the flow of hydraulic fluid to the bucket hydraulic cylinder 118 during bucket attitude control.

The Cartesian to linkage coordinate transformations discussed above use the bucket pin as a reference point and do not take into consideration bucket tip position. However, if it is more intuitive for the operator to operate the vehicle with the bucket tip as the significant end point, translation can be easily expanded to accommodate the bucket linkage.

In order to perform closed loop control using cylinder position feedback, the relative displacement (extension and retraction) of each cylinder 112,114,116,118 must be available. In the preferred embodiment, resolvers (not shown) are used to measure the relative angles between the work vehicle 156, the boom 104, the stick 106 and the bucket 108.

In an alternate embodiment, the cylinder displacement is measured directly. One suitable sensor is the radio frequency (RF) linear position sensor, as disclosed in U.S. Pat. No. 4,737,705, issued Apr. 12, 1988 to Bitar, et al. A potentiometer based sensor may also be used.

Below, in a discussion describing in depth calculations used in the coordinated control implementation, the following designations are used:

| | |
|---|---|
| L | a length of constant magnitude, |
| λ | a length of varying magnitude, |
| A | an angle of constant magnitude, and |
| Θ | an angle of varying magnitude. |

Referring back to FIG. 1B, each length (L,λ) has two subscripts, which define the two points between which the length is referenced. Each angle (A,Θ) has three subscripts, which define the the lines between which the angle is measured (the middle subscript being the vertex of the angle).

The measured relative angles from the resolvers must be converted to cylinder displacements. Based on the law of cosines, the relative cylinder displacement of the boom hydraulic cylinders 112,114, $\lambda_{cl}$ is determined by the formula:

$$\lambda_{cl}=\{[L_{bl}^2+L_{bc}^2-2L_{bl}L_{bc}\cos(A_{abl}+A_{cbe}+\Theta_{abe})\}^{\frac{1}{2}}. \quad (1)$$

Likewise, the relative displacement of the stick hydraulic cylinder 116 is determined by the formula:

$$\lambda_{df}=\{[L_{de}^2+L_{ef}^2-2L_{de}L_{ef}\cos(\pi-A_{bed}-A_{fei}-\Theta_{bei})\}^{\frac{1}{2}}. \quad (2)$$

Similarly, the relative displacement of the bucket hydraulic cylinder 118 is determined by the formula:

$$\lambda_{gj}=\{[L_{gh}^2+L_{hj}^2-2L_{gh}L_{hj}\cos(2\pi-A_{ehg}-A_{ehj}-\Theta_{jhi})\}^{\frac{1}{2}}. \quad (3)$$

In the preferred embodiment, the measured angle ($\Theta_{jhi}$) is on the linkage 158. To determine the angle of the bucket 108, $\Theta_{oim}$, relative to the stick 106 the following set of equations are used:

$$\Theta_{jhi}+\Theta_{hji}+\Theta_{kji}+\Theta_{jki}+\Theta_{hik}=2\pi, \quad (4)$$

$$\Theta_{oik}=A_{kim}+\Theta_{oim}, \quad (5)$$

$$\Theta_{hik}+A_{eih}+\Theta_{oik}=\pi, \text{ and} \quad (6)$$

$$\therefore \Theta_{oim} = -\pi + \Theta_{hji} + \Theta_{kji} + \Theta_{jki} - A_{eih} - A_{kim} + \Theta_{jhi}. \quad (7)$$

Where, $$\Theta_{hji} = \cos^{-1}[(\lambda_{ij}^2 + L_{hj}^2 - L_{hi}^2)/(2L_{hj}\lambda_{ij})], \quad (8)$$

$$\Theta_{kji} = \cos^{-1}[(\lambda_{ij}^2 + L_{jk}^2 - L_{ik}^2)/(2L_{jk}\lambda_{ij})], \quad (9)$$

$$\lambda_{ij} = \{[L_{hi}^2 + L_{hj}^2 - 2L_{hi}L_{hj}\cos(\Theta_{hji})]\}^{\frac{1}{2}}, \text{ and } (10)$$

$$\Theta_{jki} = \cos^{-1}[(L_{jk}^2 + L_{ik}^2 - \lambda_{ij}^2)/(2L_{jk}L_{ik})]. \quad (11)$$

In the linear control mode or the linear control with bucket attitude control mode, velocity request signals representative of the desired horizontal and vertical velocities are received from the control levers 130,132. The horizontal velocity request and the vertical request are integrated to determine the desired position components (x,y) of the bucket pin, point i. The desired position must be translated into desired cylinder velocity commands.

First, the desired position commands (x,y) are related to the boom 104:

$$x = L_{be}\cos\Theta_{abe} + L_{ei}\cos(\Theta_{abe} + \Theta_{bei}). \quad (12)$$

$$y = L_{be}\sin\Theta_{abe} + L_{ei}\sin(\Theta_{abe} + \Theta_{bei}). \quad (13)$$

$$\lambda_{bi} = \{[y^2 + x^2]\}^{\frac{1}{2}}. \quad (14)$$

$$\Theta_{iba} = \tan^{-1}(y/x). \quad (15)$$

$$\Theta_{ebi} = \cos^{-1}[(\lambda_{bi}^2 + L_{be}^2 + L_{ei}^2)/(2\lambda_{bi}L_{be})]. \quad (16)$$

$$\Theta_{abe} = \Theta_{ebi} + \Theta_{iba}. \quad (17)$$

$$\Theta_{abe} = \cos^{-1}[(\lambda_{bi}^2 + L_{be}^2 + L_{ei}^2)/(2\lambda_{bi}L_{be})] + \tan^{-1}(y/x). \quad (18)$$

Where, $\Theta_{abe}$ is the desired boom angle.

$\Theta_{abe}$ is transformed into desired boom cylinder length, $\lambda_{cl}$, by equation 1.

Equation 17 is differentiated to determined the desired angular velocity of the boom 104:

$$\Theta_{abe}' = \Theta_{ebi}' + \Theta_{iba}'. \quad (19)$$

$$\Theta_{abe}' = [(\cos\Theta_{ebi}/\lambda_{bi}\sin\Theta_{ebi}) - 1/L_{be}\sin\Theta_{ebi})]\lambda_{bi}' + (1/\lambda_{bi}^2)(xy' - yx'). \quad (20)$$

$$\lambda_{bi}' = (yy' + xx')/\lambda_{bi}. \quad (21)$$

$$\Theta_{abe}' = \{x[(\cos\Theta_{ebi}/\lambda_{bi}) - (1/L_{be})]/\lambda_{bi}\sin\Theta_{ebi}) - y(1/\lambda_{bi}^2)\}x' + \{y[(\cos\Theta_{ebi}/\lambda_{bi}) - (1/L_{be})]/\lambda_{bi}\sin\Theta_{ebi}) + x(1/\lambda_{bi}^2)\}y'. \quad (22)$$

Where, "'" denotes differentiation.

The desired boom cylinder velocity is determined using the equation:

$$\lambda_{cl}' = [L_{bc}L_{bl}\sin(A_{abl} + A_{cbe} + \Theta_{abe})/\lambda_{cl}]\Theta_{abe}'. \quad (23)$$

The desired stick angle is:

$$\Theta_{bei} = \cos^{-1}](L_{be}^2 + L_{ei}^2 - \lambda_{bi}^2)/(2L_{be}L_{ei}0] - \pi \quad (24)$$

Using equations 2 and 14, desired stick angular velocity is:

$$\Theta_{bei}' = [x/Lhd\ biL_{ei}\sin(\Theta_{bei} + \pi)]x' + \{y/(L_{bi}L_{ei}\sin(\Theta_{bei} + \pi)]y'. \quad (25)$$

The desired stick cylinder velocity is then determined by the equation:

$$\lambda_{df}' = -[(L_{de}L_{ef}\sin(\pi - a_{deb} - A_{fei} - \Theta_{bei})/\pi_{df}]\Theta_{bei}'. \quad (26)$$

The calculations of boom and stick desired cylinder velocities in the slope finish control mode and the slope finish with bucket attitude control mode are similar to those used in the linear control mode and the linear with bucket attitude control mode, except that the desired slope angle, $\Gamma_{slope}$ is introduced into the equations.

Therefore, the equations for the desired position of the bucket pin, point i, become:

$$x = L_{be}\cos(\Theta_{abe} + \Gamma_{slope}) + L_{ei}\cos(\Theta_{abe} + \Gamma_{slope} + \Theta_{bei}). \quad (27)$$

$$y = L_{be}\sin(\Theta_{abe} + \Gamma_{slope}) + L_{ei}\sin(\Theta_{abe} + \Gamma_{slope} + \Theta_{bei}). \quad (28)$$

The desired boom angle becomes:

$$\Theta_{abe} = \cos^{-1}[(\lambda_{bi}^2 + L_{be}^2 + L_{ei}^2)/(2\lambda_{bi}L_{be})] + \tan^{-1}(y/x) + \Gamma_{slope}. \quad (29)$$

Carrying the transofmrations through, the desired angular velocity of the boom and the stick 104,106 become:

$$\Theta_{abe}' = \{x\cos(\Gamma_{slope})[(\cos\Theta_{ebi}/\lambda_{bi}) - (1/L_{be})]/(\lambda_{bi}\sin\Theta_{ebi}) - y(1/\lambda_{bi}^2)\}x' + \{y\sin(\Gamma_{slope}[(\cos\Theta_{ebi}/\lambda_{bi}) - (1/L_{be})]/\lambda_{bi}\sin\Theta_{ebi}) - x(1/\lambda_{bi}^2)\}y'. \quad (30)$$

$$\Theta_{bei}' = = [x\sin(\Gamma_{slope})/(L_{bi}L_{ei}\sin(\Theta_{bei} + \pi)]x' + y\cos(\Gamma_{slope})/(L_{bi}L_{ei}\sin(\Theta_{bei} + \pi)]y'. \quad (31)$$

The desired boom cylinder and stick velocities are calculated using equations 23 and 26.

In the bucket attitude control option, the bucket 108 is maintained at a constant angle with respect to the vehicle. During extension(or retraction) of the boom and stick hydraulic cylinders 112,114,116, the bucket attitude angle is maintained through actuation of the bucket hydraulic cylinder 118. The stick and boom desired velocity commands are not modified.

The bucket attitude angle is related to the resolver measured angles by the equations:

$$\Theta_{abe} + (\pi + \Theta_{bei}) + (\pi + \Theta_{oim}) + (\pi - \phi) = 2\pi. \quad (32)$$

$$\Theta_{oim} = \phi - \pi - \Theta_{abe} - \Theta_{bei}. \quad (33)$$

$$\Theta_{oim}' = \phi' = \Theta_{abe}' - \Theta_{bei}'. \quad (34)$$

Where, $\Theta$, represents the bucket attitude angle.

To determine the desired angular velocity of the bucket 108, the angular velocity of the boom 104 and the stick 106 must be known.

The angular velocity of the boom is determined using commanded angular velocity as follows:

$$\lambda_{cl} = \{[L_{bc}^2 + L_{bl}^2 - 2L_{bc}L_{bl}\cos(A_{abl} + A_{cbe} + \Theta_{abe})]\}^{\frac{1}{2}}. \quad (35)$$

$$\lambda_{cl}' = [L_{bc}L_{bl}\sin(A_{abl} + A_{cbe} + \Theta_{abe})/\lambda_{cl}]\Theta_{abe}'. \quad (36)$$

$$\Theta_{abe}' = [\Theta_{cl}/(L_{bc}L_{bl}\sin(\Theta_{abe} + A_{abl} + A_{cbe}))]\lambda_{cl}'. \quad (37)$$

Likewise, the angular velocity of the stick 106 is determined:

$$A_{deb}+\Theta_{def}+A_{fei}+(\pi+\Theta_{bei})=2\pi. \quad (38)$$

$$\Theta_{bei}=\pi-A_{deb}-A_{fei}-\Theta_{def}. \quad (39)$$

$$\Theta_{def}=\cos^{-1}[(L_{de}^2+L_{ef}^2-\pi_{df}^2)/(2L_{de}L_{ef})]. \quad (40)$$

$$\Theta_{bei}'=[\lambda_{df}/(L_{de}L_{ef}\sin(\pi-a_{deb}-A_{fei}-\Theta_{bei})]\lambda_{df}'. \quad (41)$$

Therefore, the desired bucket angular velocity is determined as:

$$\therefore\Theta_{oim}'=\phi'-[\Theta_{cl}/(L_{bc}L\sin(\Theta_{abe}+A_{ab-l}+A_{cbe}))]\lambda_{cl}'+[\lambda_{df}/(L_{de}L_{ef}\sin(\pi-a_{deb}-A_{fei}-\Theta_{bei})]\lambda_{df}'. \quad (42)$$

Where, $\phi'$ is a requested bucket velocity input form one of the control levers 130,132.

The desired bucket cylinder velocity is determined using the desired angular velocity of the bucket and the equations:

$$\Theta_{hji}=\pi-\Theta_{hji}\Theta_{kji}-\Theta_{jki}+A_{eih}+A_{kim}+\Theta_{oim}. \quad (43)$$

$$\Theta_{ij}'=(L_{hi}L_{hj}\sin(\Theta_{jhi})/\lambda_{ij})\Theta_{hji}'. \quad (44)$$

$$\Theta_{hji}'=-\Theta_{hji}'-\Theta_{kji}'-\Theta_{hki}'+\Theta_{oim}'. \quad (45)$$

$$\Theta_{hji}'=\{L_{hi}\sin\Theta_{hji}[L_{hj}\cos(\Theta_{hji})/\lambda_{ij}-1]/(\lambda_{ij}\sin\Theta_{hji})\}\Theta_{hji}'. \quad (46)$$

$$\Theta_{kji}'=\{L_{hi}L_{hj}\sin\Theta_{hji}[L_{hk}\cos(\Theta_{kji})/\lambda_{ij}-1]/(L_{jk}\lambda_{ij}\sin\Theta_{kji}0\}\Theta_{jhi}'. \quad (47)$$

$$73\ {}_{hki}'=[L_{hi}L_{hj}\sin\Theta_{hji}/(L_{jk}L_{ik}\sin\Theta_{jki})]\Theta_{jhi}'. \quad (48)$$

$$\Theta_{hji}'=[1/(1+\Theta_{hji}'+\Theta_{kji}'+\Theta_{hki}')]\Theta_{oim}'. \quad (49)$$

$$\lambda_{gj}'=(-L_{gh}L_{hj}\sin(2\pi-A_{ehg}-A_{ehi}-\Theta_{jhi})/\lambda_{gj})\Theta_{hji}'. \quad (50)$$

In the slope finish with bucket attitude control mode, equation 33 is modified to compensate for the desired slope angle:

$$\Theta_{oim}=\phi-\pi-(\Theta_{abe}-\Theta_{slope})-\Theta_{bei}. \quad (51)$$

The desire bucket cylinder velocity is determined in the same manner as describe above.

Industrial Applicability

With reference to the drawings, and in operation, the present invention is adapted to provide a coordinated control for a work vehicle's work implement. In the excavator, as discussed above, a manual control mode is provided. An operator using the control levers 130,132 operates the work implement 102 to perform the digging operations typical in the vehicle's work cycle, in a normal manner.

However, in order to automatically "finish" or provide a smooth surface using the bucket 108, one of the additional modes of the control system 100 is used. For example, to provide a level floor, the operator manually positions the bucket 108 at a point on the desired path. The control system 100 is transferred to the linear control mode. In the linear control mode, linear horizontal movement of the bucket pin (point i) is controlled by movement of the first control lever 130 along the first control axis 136. Therefore, the operator need only pull back on the first control lever 130 and the control system 100 coordinates flow of hydraulic fluid to the cylinders 112,114,116 to provide the linear movement. Linear vertical movement is provided by movement of the first joystick along a second control axis 138. Alternatively, vertical movement may be controlled by a second control lever 132.

In the slope finish control modes, the operator must also signal the control system 100 as to the desired slope angle. In the preferred embodiment, the operator simply dials in the desired slope angle on the thumb wheel switch 146.

In an alternate embodiment, the operator first positions the bucket 108 at a first point on the desired slope and signals the control system 100. Then the operator positions the bucket 108 at a second point on the desired slope and signals the control system (100). The control system then calculates the desired slope based on the bucket positions.

In the bucket attitude control modes (linear and slope), the operator positions the bucket at the desired bucket attitude angle prior to engaging the linear or slope control mode.

We claim:

1. A control system for controllably movign a vehicle's work implement, said work implement having a first appendage pivotally connected to said vehicle, and a second appendage having first and second end points and being pivotally connected to said first appendage at said first end point, comprising:

first actuating means for controllably moving said first appendage relative to said vehicle;

second actuating means for controllably moving said second appendage relative to said first appendage;

operator interface means for producing first and second control signals, said control signals being indicative of a desired linear velocity;

logic means for receiving said first control signal and rseponsively producing a substantially linear motion of the second end point of said second appendage in a first work direction along a first work axis by coordinating said first and second actuating means and for receiving said second control signal and responsively producing a substantially linear motion of the second end point of said second appendage in a second work direction along said first work axis by coordinating said first and second acutating means, wherein said linear motion has a velocity proportional to said respective control signal; and wherein said operator interface means includes means for producing third and fourth control signals and said logic means includes means for receiving said third control signal and responsively producing a substantially linear motion of the second end point of said second appendage in a third work direction along a second work axis by coordinating said first and second actuating means, and for receiving said fourth control signal and responsively producing a substantially linear motion of the second end point of said second appendage in a fourth work direction along said second work axis by coordinating said first and second actuating means, said fourth work direction being opposite said third work direction, said second work axis being substantially perpendicular to said first work axis, and wherein said linear motion in said third and fourth work directions having velocities proportional to said third and fourth control signals, respectively.

2. A control system, as set forth in claim 1, including means for producing a slope angle signal indicative of the desired slope angle and wherein said logic means includes means for receiving said slope angle signal and wherein said linear motion of said second end point has an angular relationship with respect to a horizontal plane porportional to said slope angle signal.

3. A control system, as set forth in claim 1, including a switch, said switch being operator manipulative and being so constructed and adapted to produce a desired slope angle signal and wherein said logic means includes means for receiving said slope angle signal and wherein said linear motion of said second end point has an angular relationship with respect to a horizontal plane proportional to said slope angle signal.

4. A control system, as set forth in claim 1, wherein said first work axis is substantially vertical and said second work axis is substantially horizontal with respect to said vehicle.

5. A control system, as set forth in claim 1, including a third appendage pivotally connected to said second appendage and third actuating means for controllably moving said third appendage relative to said second appendage.

6. A control system, as set forth in claim 5, wherein said operator interface means includes means for producing a fifth control signal, and wherein said logic means includes means for receiving said fifth control signal and being adapted to responsively actuate said third actuating means.

7. A control system, as set forth in claim 6, wherein said third appendage has an angular relationship with a horizontal plane and said logic means including means for coordinating said first, second, and third actuating means to maintain said angular relationship during said linear motion.

8. A control system, as set forth in claim 1, wherein said operator interface means includes a first control lever.

9. A constrol system, as set forth in claim 1, wherein said operator interface means includes a first control lever movable in first and second control directions along a first control axis and in third and fourth control directions along a second control axis, and wherein said operator interface means produces said first, second, third, and fourth control signals in response to movement of said first control lever in said first, second, third and fourth control directions, respectively.

10. A control system, as set forth in claim 1, wherein operator interface means includes a first control lever movable in first and second directions along a first control axis and a second control lever movable in first and second control directions along a second control axis.

11. A control system, as set forth in claim 1, including:

a third appendage pivotally connected to said second appendage;

third actuating means for controllably movign said third appendage relative to said second appendage; and wherein said third appendage has an angular relationship with a horizontal plane and said logic means including means for maintaining said angular relationship during said linear motion.

12. A control system, as set forth in claim 11, wherein said operator interface means includes a first control lever.

13. A control system, as set forth in claim 11, wherein said operator interface means includes a first control lever movable in first and second control directions along a first control axis and in third and fourth control directions along a second control axis.

14. A control system, as set forth in claim 11, wherein said operator interface means includes a first control lever movable in first and second control directions along a first control axis and in third and fourth control directions along a second control axis, and wherein said operator interface means produces said first, second, third, and fourth control signals in response to movement of said first control lever in said first, second, third and fourth control directions, respectively.

* * * * *